United States Patent [19]

Ritter et al.

[11] Patent Number: 4,930,427

[45] Date of Patent: Jun. 5, 1990

[54] RAILROAD GONDOLA OR HOPPER CAR, PARTICULARLY A COAL CAR

[75] Inventors: John A. Ritter, Cincinnati, Ohio; Jan Z. Tomaka; Jozes A. Muda, both of Quebec, Canada

[73] Assignees: Thrall Car Manufacturing Company, Chicago Heights, Ill.; Alcan International Limited, Quebec, Canada

[21] Appl. No.: 277,776

[22] Filed: Nov. 30, 1988

Related U.S. Application Data

[63] Continuation-in-part of Ser. No. 128,930, Dec. 4, 1987, Pat. No. 4,840,127.

[51] Int. Cl.[5] ..... B61D 17/10

[52] U.S. Cl. ..... 105/406.1; 105/407; 105/414; 105/416; 105/411

[58] Field of Search ..... 105/406.1, 406 R, 407, 105/414, 416, 244, 411

[56] References Cited

U.S. PATENT DOCUMENTS

| | | | |
|---|---|---|---|
| 3,866,545 | 2/1975 | Heap | 105/406.1 |
| 3,964,399 | 6/1976 | Miller et al. | 105/406.1 |
| 4,024,821 | 5/1977 | Yang | 105/411 |
| 4,079,676 | 3/1978 | Miller | 105/406.1 |
| 4,082,045 | 4/1978 | McNally et al. | 105/406.1 |
| 4,408,542 | 10/1983 | Heap | 105/406.1 |
| 4,417,526 | 10/1983 | Marulic et al. | 105/406.1 |
| 4,840,127 | 6/1989 | Tomaka | 105/406.1 |

*Primary Examiner*—Andres Kashnikow
*Assistant Examiner*—Virna Lissi Mojica
*Attorney, Agent, or Firm*—Marshall, O'Toole, Gerstein, Murray & Bicknell

[57] ABSTRACT

A railroad gondola car having improved side sills, internal horizontal tension braces and diagonal braces with cast metal connectors at the ends of the braces and doubler plates on the side wall post flanges for reinforcement purposes where posts are connected to the ends of the body bolsters and where the braces are connected to the car side walls opposite a side wall post.

26 Claims, 4 Drawing Sheets

FIG.7
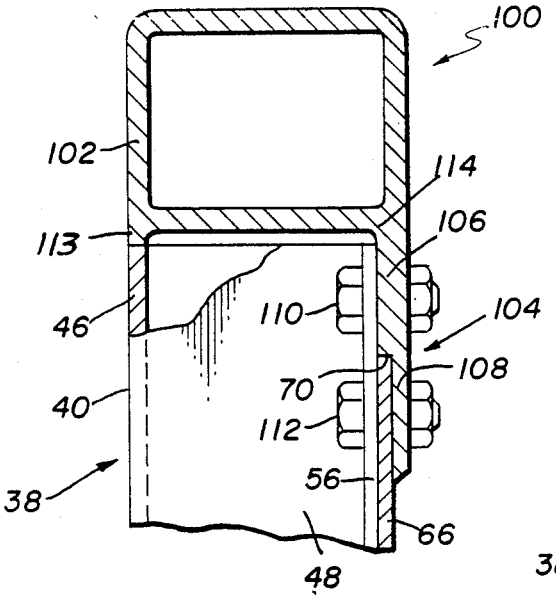
FIG.8
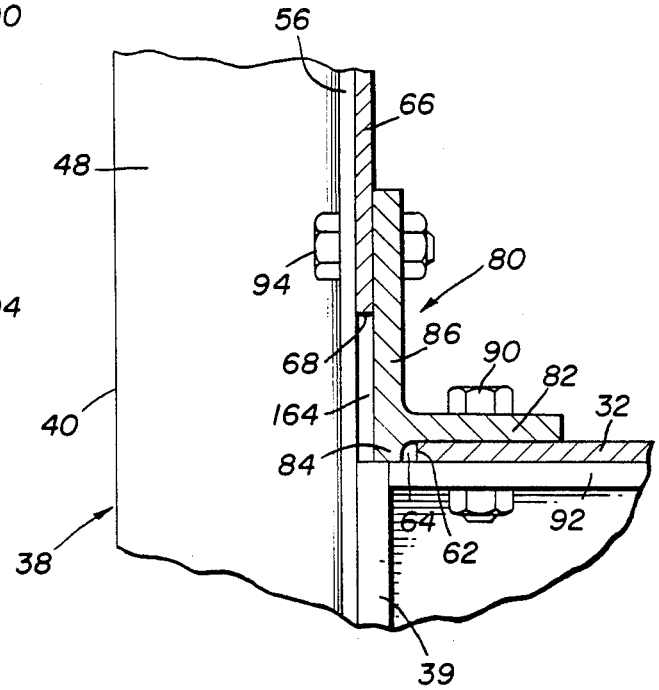
FIG.9
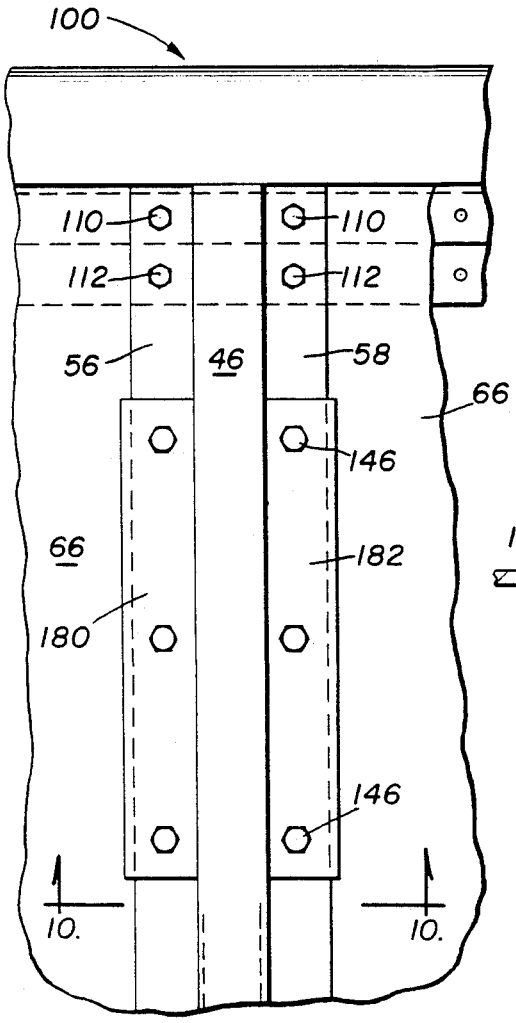
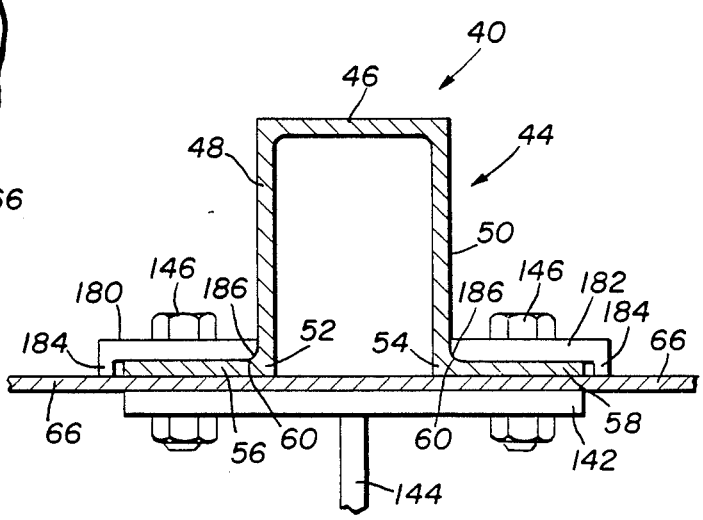
FIG.10

RAILROAD GONDOLA OR HOPPER CAR, PARTICULARLY A COAL CAR

This application is a continuation-in-part of pending U.S. patent application Ser. No. 128,930 filed Dec. 4, 1987, now U.S. Pat. No. 4,840,127 issued Jun. 20, 1989.

This invention relates to a railroad gondola car, and particularly to a high side gondola car for carrying coal.

BACKGROUND OF THE INVENTION

Railroad gondola cars are typically open or uncovered cars and they are used to carry a large variety of industrial cargo. High side gondola cars or hopper cars are especially useful for transporting coal, particularly in unit trains, to destinations where the cars can be readily and quickly emptied through bottom discharge gates or by rotary dumping of the cars.

Gondola cars are subject to severe conditions when they are being loaded and unloaded as well as during travel over the railway track. The applied stresses are particularly high where the side wall posts are connected to body bolsters, cross bearers, cross ties, side sills and top side chords and where internal body braces are connected to the car floor and side walls. These structural areas of the car are of concern not only in cars made all of steel but are of even greater concern in cars having a steel underframe and an aluminum body because aluminum has a significantly lower strength and ductility than steel. There is thus a need for structural improvements in gondola cars so that the railroads and the customers have durable and reliable cars which meet their needs.

SUMMARY OF THE INVENTION

According to the invention a plurality of improvements is provided in a railroad gondola car comprising a center sill; a pair of generally vertical car end walls; a pair of generally vertical car side walls joined to the end walls; a longitudinal side sill at the bottom of each car side wall; a longitudinal top chord at the top of each car side wall; a body bolster near each end of the car extending from the center sill to the side sills; a railway truck having a bolster; each body bolster being supported on a railway truck bolster; a plurality of cross bearers extending from the center sill to the side sills; each vertical car side wall including a vertical plate having a lower horizontal edge joined to the side sill and an upper horizontal edge joined to the top chord; a plurality of spaced apart vertical posts joined to the vertical plate and with one or more of the vertical posts being joined to the body bolsters and to the cross bearers; and a floor plate supported by the body bolsters and the cross bearers with said floor plate extending for substantially the distance between the car end walls and the car side walls.

Generally, a post will be joined at the bottom to each body bolster and posts will also be joined at the bottom to a plurality of cross bearers.

One of the gondola car improvements has the floor plate side edges spaced inwardly a short distance from the respective side plates and with each side sill having a horizontal leg on top of the floor plate and a downwardly depending rib on the bottom of the horizontal leg extending into contact with the body bolsters and cross bearers between the respective edges of the floor plates and the car side wall plates.

Each side sill can be a right angle structural member having a vertical leg extending upwardly from the horizontal leg and with the vertical leg joined to the car side wall. The rib can be positioned below and as an extension of the vertical leg. The bottom of the rib will contact the top of the body bolsters and cross bearers thereby assisting the load transfer between these underframe members and the side posts and thus will reduce the stresses in the side posts.

A second gondola car improvement provided by the invention comprises a cast metal connector at each end of a tension tie lateral horizontal brace located above each body bolster but near the top of the car body.

Each tension tie lateral horizontal brace can be a tubular member. The end of each tubular member can have a separate cast metal connector telescoped onto the tubular member. The cast connector can have an end with an axial slot or groove extending inwardly from the end of the casting. The car side wall opposing upper internal portion can have a T-member positioned thereon, with said T-member having the flanges of the T against the car side wall vertical plate and with the stem of the T being vertically positioned. The stem of each T-member on the car side walls can be located in the slot of a casting on the end of the horizontal brace.

Each T-member on the inside of a car side wall can be located adjacent a car side post on the outside of a car side wall and it can extend upwardly from a body bolster. Doubler plates, such as subsequently described, can be positioned on the post hat-section flanges and fasteners can extend through the doubler plate, hat-section flanges, car side wall plate and the flanges of the T-member to connect these elements together to provide a strong attachment means to which the tension tie horizontal brace casting can be connected.

Another gondola car improvement provided by the invention comprises at least two pair of diagonal braces located inside the car between the car side walls with each pair of diagonal braces comprising two opposing braces each of which has a separate cast metal connector at its upper end connected to an upper internal portion of a car side wall and a separate cast metal connector on each lower end connected to means on the car floor.

Each diagonal brace can be a tubular member and the end of each tubular member can have the metal cast connector telescoped onto or into the tubular member. The cast connector can have an end with an axial slot extending inwardly from the end of the casting. The car side wall upper internal portion can have a T-member positioned thereon, with said T-member having the flanges of the T against the car side wall vertical plate and with the stem of the T being vertically positioned. The car floor can have a T-member positioned thereon with said T-member having the flanges of the T against the floor plate and the stem of the T vertically positioned and lateral to the car side walls. The stem of the T-member on the side wall can be located in the slot of the casting on the upper end of a diagonal brace and the stem of the T-member on the floor plate can be located in the slot of the casting on the lower end of the diagonal brace.

The castings can be connected to the T-member stems by mechanical fasteners which extend through the castings and also through the T-member stems.

Each T-member on a car side wall desirably is opposite a hat-section side wall post and also, desirably, in a vertical plane above a cross bearer.

Doubler plates, such as subsequently described, can be located along the flanges of the hat-section posts opposite the T-member on the inside of the car side wall to which the castings on the upper ends of the diagonal braces are connected.

Still another gondola car improvement provided by the invention has most, if not all, of the side posts in the form of a hat-section structural member comprising a channel portion with a base flange, side webs extending normal to the flange and having top edges, and flanges extending outwarding from the side web top edges; the hat-section flanges contacting the car side wall vertical plate; a doubler plate over and in contact with each hat-section flange adjacent a vertical plate on each end of the body bolsters and adjacent portion of the car side wall; and fastener means penetrating the doubler plates, hat-section flanges, car side wall and body bolster vertical end plate to secure the said elements together.

Each doubler plate referred to above can be an elongated member wider than the top of the hat section flange which it contacts. The outer edge of the double plate can have a short flange which projects into contact with the side wall vertical plate. The inner edge of the doubler plate can be rounded and nest in a concavely curved root portion of the hat-section post formed by the intersection of the hat-section side walls and outwardly extending flanges.

The doubler plate will reduce the stresses in the critical bolster post area which are the result of transferring loads between the body bolsters and side posts. Since the short flange on the outer edge of the doubler plate contacts the side wall sheet or plate and the inner edge of the doubler plate is in contact with the curved root portion of the hat section post, the surface bearing contact between the flanges of the hat-section post and the side sheet or plate is maintained and this further reduces the stresses in the post and the fastener means.

BRIEF DESCRIPTION OF THE DRAWINGS

FIG. 7 is an enlarged sectional view of the side wall top chord shown in FIGS. 3 and 4 and the manner in which the side wall posts and side plate are joined to the top chord;

FIG. 8 is an enlarged sectional view of the side sill and the manner in which the side wall plate, side wall posts and floor plate are joined to the side sill;

FIG. 9 is an enlarged elevational view of the upper portion of the car side wall post which extends upwardly from the end of the body bolster; and FIG. 10 is a sectional view taken along the line 10—10 of FIG. 9.

DETAILED DESCRIPTION OF THE DRAWINGS

To the extent it is reasonable and practical the same or similar elements which appear in the various views of the drawings will be identified by the same numbers.

Figure 1:
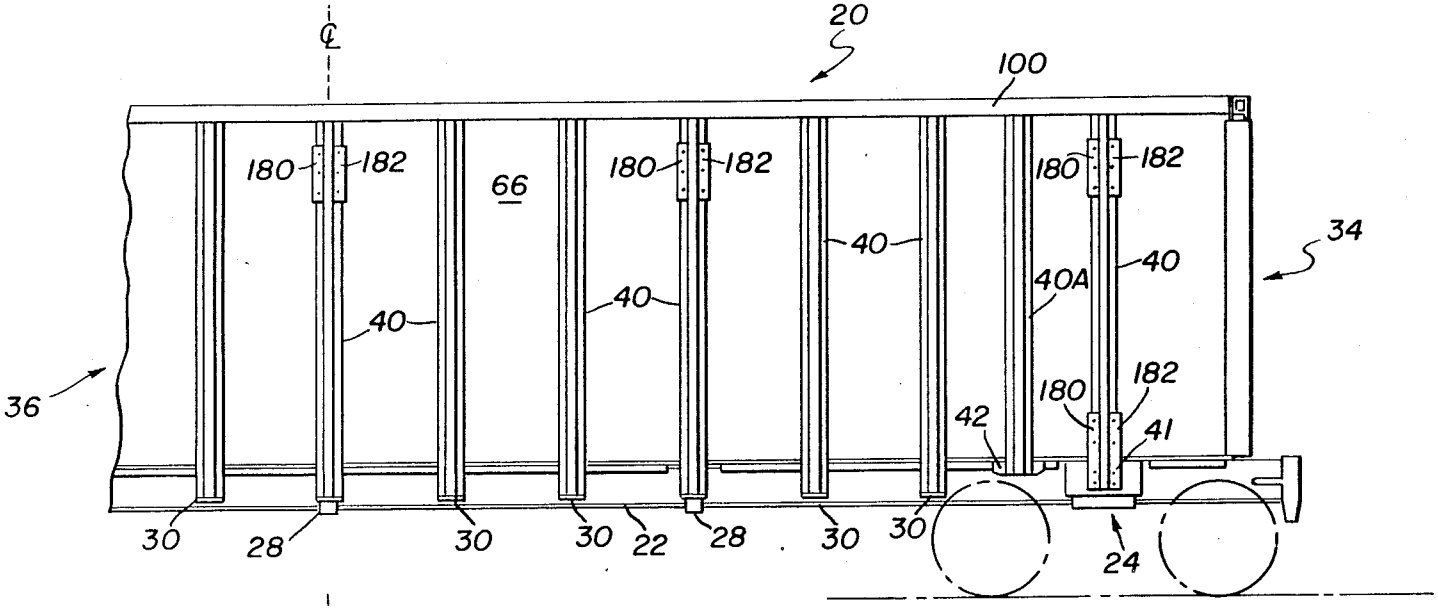
FIG. 1 is a side elevational view of slightly more than one-half of a railroad gondola car, desirably having an aluminum body and a steel underframe, provided by the invention.
Figure 2:
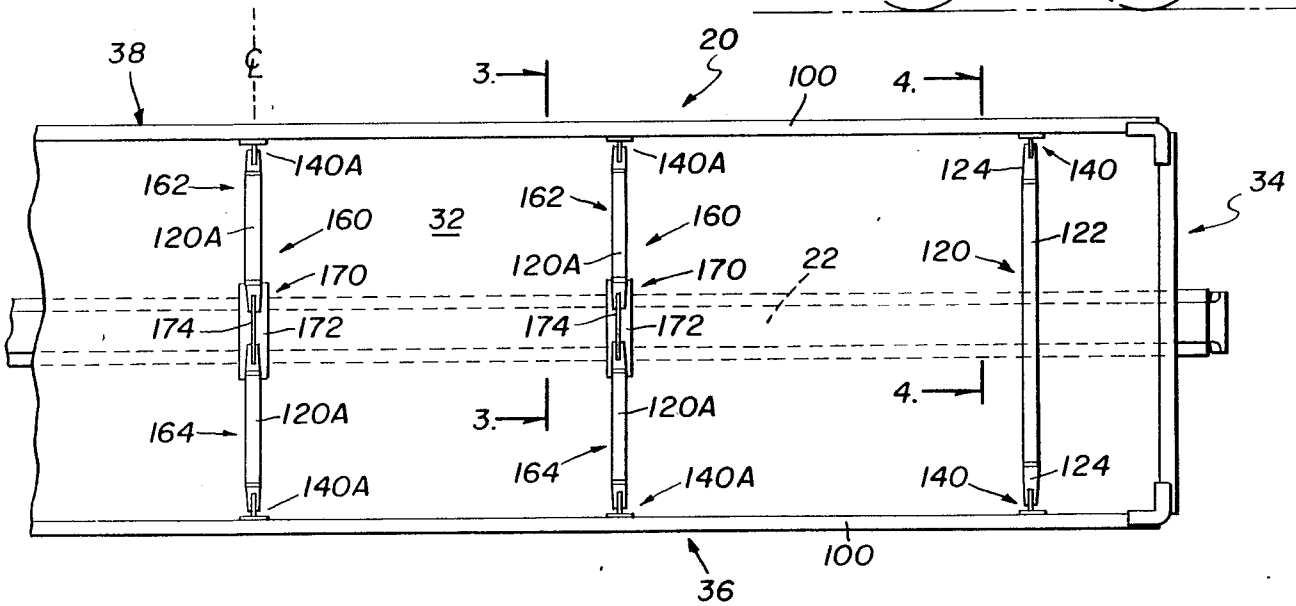
FIG. 2 is a plan view of the gondola car shown in FIG. 1.

The high side railroad gondola car 20 illustrated in FIGS. 1 and 2 has a steel center sill 22 with a lateral steel body bolster 24 (FIG. 4) at each end. A center bearing plate 26 is mounted on the bottom of each body bolster 24. The center bearing plate 26 is supported in the truck bolster bowl of a conventional railroad four wheel two axle truck, not shown.

Also extending laterally outwardly from center sill 22 are three spaced apart cross bearers 28 and five cross ties or minor cross bearers 30 which are in the nature of cross bearers 28 but which are lighter and of lower strength but which can also be considered to be cross bearers. The top surfaces of the cross bearers 28,30 lie in a common horizontal plane and support a floor plate 32.

The gondola car 20 has an aluminum end wall 34 at each end and a pair of identical aluminum side walls 36,38. The outer ends of each of the cross bearers 28,30 have a vertical end plate 39 to which the lower end of an aluminum wall side post 40 is connected by mechanical fasteners 41 such as rivets, bolts or Huckbolts. The lower end of aluminum post 40A may or may not be located at a cross bearer so it could be connected, in part, to a reinforcing angle member 42 beneath floor plate 32 (FIG. 1).

The top end of each of the side posts 40,40A terminates at the same elevation in a horizontal line. The aluminum side posts are structural members identical in lateral section and have what can be referred to as a hat-section shape (FIG. 10). The hat-section shape comprises a channel portion 44 with a base flange 46, side webs 48,50 normal to base flange 46 and having top edges 52,54, and with flanges 56,58 extending outwardly from the side web top edges. The flanges 56,58 are in the same plane. The intersection of side web 48 and flange 56, as well as side web 50 and flange 58, are curved 60 at a suitable root radius for strength.

The floor plate 32 longitudinal side edges 62 (FIG. 8) terminate a short distance inwardly from the flanges 56,58 of the side posts 44 thereby providing a gap 64 therebetween. A further gap 164 is provided between flanges 56,58 and side sill 80.

A side wall plate 66 is attached to the inside surface of side post flanges 56,58. The side wall plate 66 has its lower longitudinal horizontal edge 68 positioned slightly above the top of floor plate 32 thereby further defining gap 164 while the upper longitudinal horizontal edge 70 is positioned a few inches below the top of the side posts 40 (FIGS. 7 and 8).

A longitudinal side sill 80 is positioned at the bottom part of each car side wall 36,38. Each side sill 80 is a right angle structural member having a horizontal leg 82 on top of floor plate 32 and a downwardly depending rib 84 on the bottom of the horizontal leg 82 extending into contact with the body bolsters and cross bearers in the gaps 64 and 164 between the edge 62 of the floor plate and the lower edge 68 of the side wall plate 66 (FIG. 8). The side sill also has a vertical leg 86 extending upwardly from the horizontal leg 82 and with the vertical leg 86 joined to the car side wall. The rib 84 can be considered an extension of the vertical leg 86. Mechanical fasteners, such as bolts 90, extend through horizontal leg 82, floor plate 32 and through the top plate 92 of either a body bolster or cross bearer. Mechanical fasteners, such as bolts 94, extend at least through vertical leg 86, side wall plate 66 and flanges 56,58 of the side wall posts 40. The bolts can also extend through doubler plates 180,182 when used as will be discussed hereinafter.

When a load is applied against a car side wall 36,38 interior surface it is transferred by the side wall posts to the outer ends of the body bolsters and cross bearers as well as to the side sill vertical leg 86. The force tries to pull the vertical leg 86 outwardly thereby causing the rib 84 to be pressed against the top of the body bolster and cross bearers in resisting the applied force in addition to the vertical body bolster load as described previously above. Without the rib 84 this force could not be resisted as successfully.

The top of each side wall has a top chord 100 which extends the length of the car body and is joined to the end walls 34. The top chord 100 is a P-tube structural member 102 located on top of the posts 40 and having a downwardly depending stepped flange 104 having a relatively thicker longitudinal portion 106 joined directly to the flanges 56,58 of the side wall posts 40 and a thinner portion 108 overlapping the upper edge 70 of the side wall vertical plate 66 (FIG. 7). Mechanical fasteners, such as bolts 110, extend through the thicker portion 106, side wall plate 66 and side post flanges 56,58 thereby joining these elements together. Similarly, bolts 112 extend through the thinner portion 108, side wall plate 66 and side post flanges 56,58 thereby joining these elements together. A rib 113 projects downwardly from the tubular portion of P-tube 102 (FIG. 7). The rib 113 runs the length of the top chord and is positioned to contact the top of flange 46 of each side post 40. The rib 113 permits the bottom of the P-tube tubular portion to be located slightly spaced above the top of the side posts 40 to accommodate the concavely curved internal corner 114 where the stem 104 joins the tubular portion.

The described structure of the P-tube permits it to resist lateral forces from each side. Thus, lateral force applied from inside the car, as well as a downward vertical force, causes the rib 113 to press against web 46 while a lateral force applied from outside the car is opposed by the tubular portion itself as well as the thicker portion 106 of stem 104.

A lateral horizontal tension tie cross brace 120 is located above each body bolster 24 (FIG. 4) near the top of the car body. Each lateral cross brace 120 is a tubular aluminum member 122 circular in cross section with a cast aluminum connector 124 at each end.

Figure 5:
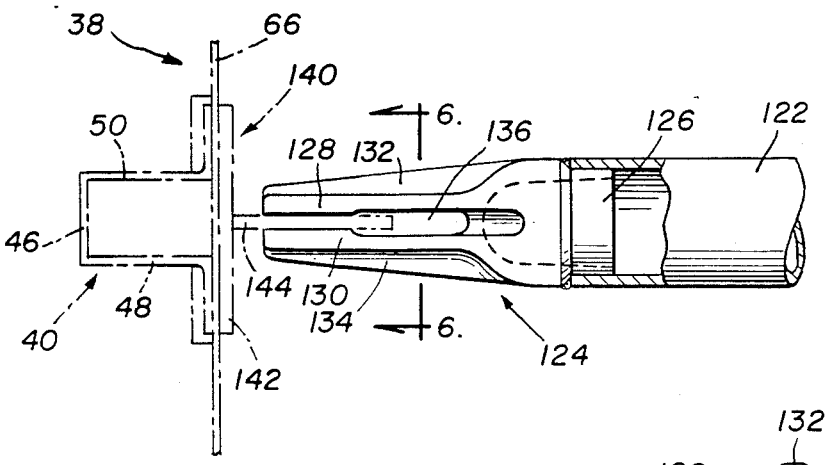
FIG. 5 is a sectional view taken along the line 5—5 of FIG. 4.
Figure 6:
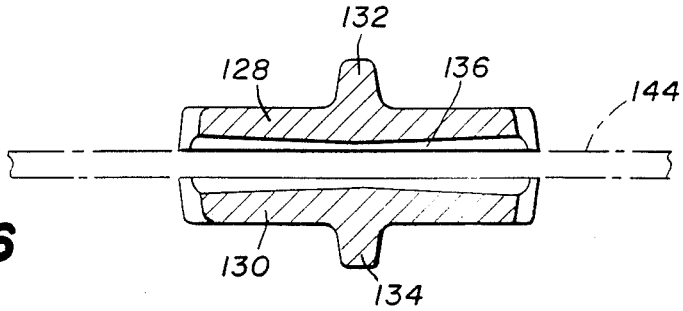
FIG. 6 is a sectional view taken along the line 6—6 of FIG. 5.

Each cast connector 124 has a short cylindrical end 126 which telescopes into the end of tubular member 122 and is welded thereto (FIG. 5). The cast connector 124 also has a pair of mirror image walls 128,130 separated by an axial slot or groove 136 extending inwardly from the end of the casting. Wall 128 is reinforced by an external rib 132 and wall 130 is reinforced by an external rib 134.

Each car side wall upper internal portion is provided with a T-member 140 which has a flange 142 against the car side wall vertical plate 66 and a stem 144 of the T vertically positioned (FIGS. 4 and 5) and protruding outwardly from the wall towards the car interior.

The flange 142 on both sides of stem 144 is connected to the car side wall by mechanical fasteners, such as bolts 146, which extend at least through the flange 142, side wall plate 66 and the side post flanges 56,58. The walls 128, 130 of the cast connectors are connected to a respective stem 144 by mechanical fasteners, such as bolts 146, which extend through the stem and casting walls. The use of mechanical fasteners provides improved strength compared to welding, speeds car manufacturing and provides connections which are not brittle.

The gondola car is also provided with three pair of diagonal braces 160 located inside the car between the side walls 36, 38 above respective major cross bearers. Each pair of diagonal braces comprises two opposing identical braces 162,164 which are essentially like the lateral cross braces 120. Each diagonal brace 162,164 has a tubular member 120A, like tubular member 120, and a cast connector 124A, like cast connector 124, at each end.

The upper ends of the diagonal braces are connected to a T-member 140A located on each side wall upper internal portion above a cross bearer. T-member 140A is essentially like T-member 140. T-member 140A has a flange 142A, located against the car side wall vertical plate 66 opposite a side post 40, and a stem 144A of the T-member vertically positioned (FIG. 3) and protruding outwardly from the wall towards the car interior.

Mechanical fasteners, such as bolts 166, extend through stem 144A of T-member 140A and through the walls of cast connector 124A on the upper end of each brace 162,164 and thereby connect the brace to the stem. Mechanical fasteners, such as bolts 168, extend through flange 142A, side wall plate 66, and side post flanges 56,58 to connect it to the side wall.

Figure 3:
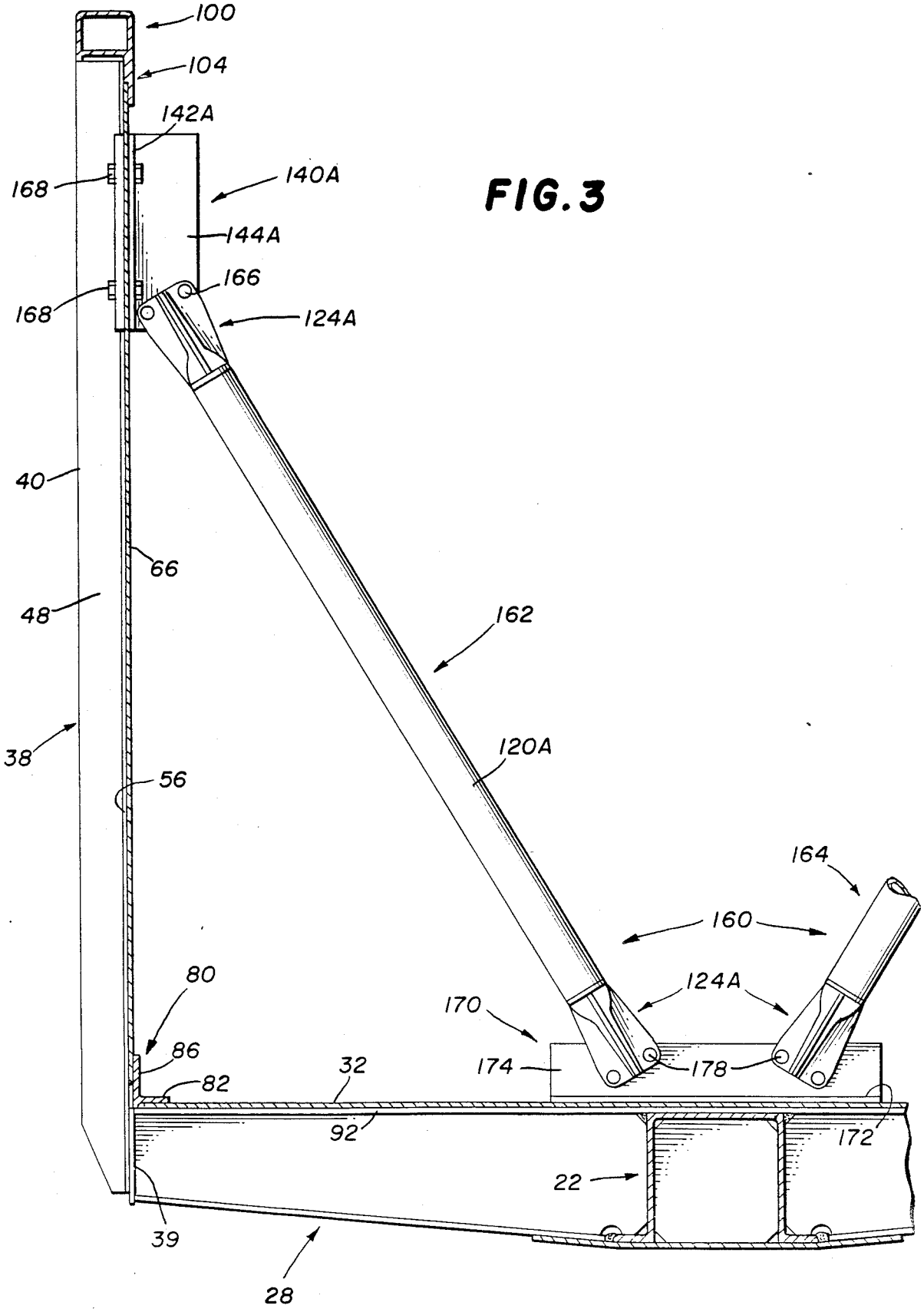
FIG. 3 is a sectional view taken along the line 3—3 of FIG. 2.

The car floor plate 32 has a T-member 170 laterally positioned over the center sill in line with a major cross bearer. The T-member 170 has a horizontal flange 172 in contact with floor plate 32 and a vertical upwardly extending stem 174 (FIGS. 2 and 3). The stem 174 fits into the slot or groove 136 in the cast metal connectors on the lower ends of the diagonal braces 162,164. Mechanical fasteners, such as bolts 178, extend through the cast metal connector walls and stem 174 and thereby join the braces to the T-member 170. Similar mechanical fasteners not shown join the flange 172, floor plate 32 and cross bearer top plate 92 together.

The cast metal connectors 124,124A can, but need not, be identical. If identical, the same part can be used on the horizontal and diagonal braces. However, different sized connectors can be designed for the specific loads on the different braces and in that case the connectors would not all be identical.

Because of the increased loads and forces which are applied to the lower ends of the side wall posts connected to the ends of the body bolsters and where the ends of the cross braces and upper ends of the diagonal braces are connected to the T-members on the car interior side walls it is considered desirable to reinforce one or more or all of these locations by use of special doubler plates mounted over the flanges 56,58 of the adjacent hat-section posts and to have the same mechanical fasteners already described also extend through such doubler plates.

Figure 4:
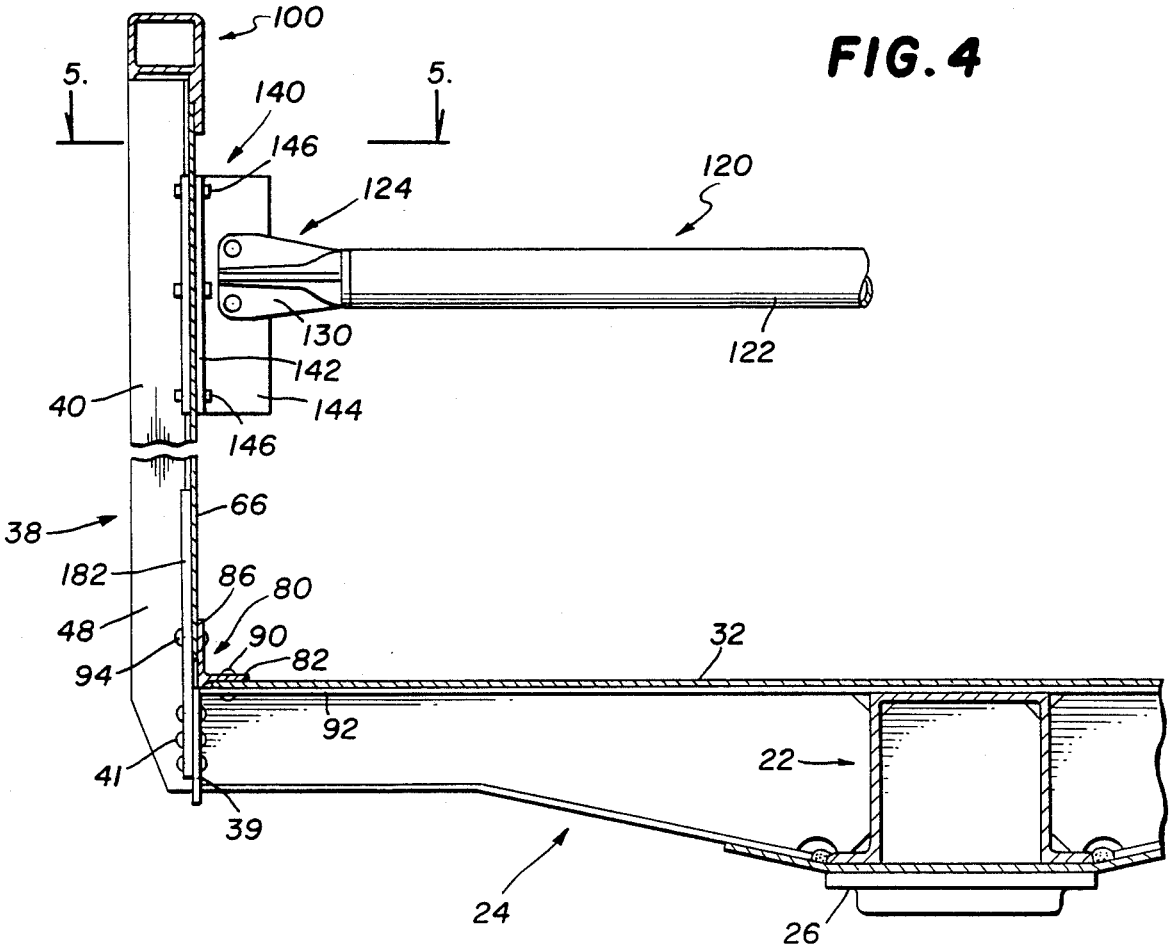
FIG. 4 is a sectional view taken along the line 4—4 of FIG. 2.

FIGS. 4, 9 and 10 illustrate the use of doubler plates 180,182 to reinforce the area where the cross brace 120 connects with the car side walls 36,38. Each doubler plate 180,182 is an elongated member wider than the top of a hat section flange 56,58 which it contacts. The outer edge of each doubler plate 180,182 has a short flange 184 which projects into contact with the car side wall vertical plate 66. The inner edge of each doubler plate is rounded 186 and nests in the concavely curved root portion 60 of the hat-section post formed by the intersection of a post side web 44,48 and an outwardly extending flange 58,56. An exceptionally strong joint is obtained by use of doubler plates having the described shape because the bearing between the outwardly extending flanges 56,58 of the posts and the car wall side sheet or plate is maintained.

Although the use of the doubler plates 180,182 has been described in conjunction with the cross brace connections to the car side walls, the same or similar doubler plates can be used to reinforce the connection where the wall side post 40 is connected to the body bolster end plate 39 (FIGS. 1 and 4) and where the upper ends of the diagonal braces 162,164 are connected to the car side walls. It should be understood that when doubler plates are used the same previously described mechanical fasteners need only be slightly longer to extend through them to complete the connection without using additional or supplemental fasteners.

The foregoing detailed description has been given for clearness of understanding only, and no unnecessary limitations should be understood therefrom, as modifications will be obvious to those skilled in the art.

What is claimed is:

1. A railroad gondola car comprising:

a center sill;

a pair of generally vertical car end walls;

a pair of generally vertical car side walls joined to the car end walls;

a longitudinal side sill at the bottom of each car side wall;

a longitudinal top chord at the top of each car side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical side wall plate having a lower horizontal edge joined to the side sill and an upper horizontal edge joined to the top chord;

a plurality of spaced apart vertical posts joined to the vertical side wall plate and with one or more vertical posts being joined to body bolsters and cross bearers;

a floor plate supported by the body bolsters and the cross bearers with said floor plate extending for substantially the distance between the end walls and the side walls but having side edges spaced inwardly a short distance from the respective side plate; and each side sill having a horizontal leg on top of the floor plate and a downwardly depending rib on the bottom of the horizontal leg extending into contact with the body bolsters and cross bearers between the respective edges of the floor plates and the car side wall plate.

2. A gondola car according to claim 1 in which each side sill is a right angle structural member having a vertical leg extending upwardly from the horizontal leg and with the vertical flange joined to the car side wall plate.

3. A gondola car according to claim 2 in which the rib is positioned below and as an extension of the vertical leg.

4. A gondola car according to claim 1 in which:

each post is a hat section structural member comprising a base flange, side webs extending normal to the flange and having top edges and flanges extending outwarding from the side web top edges; and the outwardly extending flanges contact the car side wall vertical plates.

5. A gondola car according to claim 4 in which:

a doubler plate is located over and in contact with each hat-section outwardly extending flange adjacent a vertical plate on each end of the body bolsters and adjacent portion of the car side wall; and mechanical fastener means penetrates the doubler plates, hat-section outwardly extending flanges, side wall plates and body bolster vertical end plate to secure the said elements together.

6. A gondola car according to claim 5 in which:

each doubler plate is an elongated member wider than the top of the hat section outwardly extending flange which it contacts;

the outer edge of the doubler plate has a short flange which projects into contact with the car side wall vertical plate; and the inner edge of the doubler plate is rounded and nests in a root portion of the hat-section post formed by the intersection of the hat-section post side webs and outwardly extending flanges.

7. A gondola car according to claim 1 in which:

at least two pair of diagonal braces are located inside the car between the side walls; and each pair of diagonal braces comprises two opposing braces each of which has a cast metal connector at an upper end connected to an upper internal portion of a car side wall and a cast metal connector at a lower end connected to means on the car floor.

8. A gondola car according to claim 1 in which:

a lateral horizontal tension tie cross brace is located above each body bolster;

each lateral cross brace has a cast connector at each end; and means joins each cast connector to the car side wall.

9. A railroad gondola car comprising:

a center sill;

a pair of generally vertical car end walls;

a pair of generally vertical car side walls joined to the car end walls;

a longitudinal side sill at the bottom of each side wall;

a longitudinal top chord at the top of each car side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical plate having a lower horizontal edge joined to the side sill and an upper horizontal edge joined to the top chord;

a plurality of spaced apart vertical posts joined to the vertical plate and with one or more vertical posts being joined to the body bolsters and to the cross bearers;

a floor plate supported by the body bolsters and the cross bearers with said floor plate extending between the car end walls and the car side walls;

each post is a hat-section structural member comprising a base flange between side webs extending normal to the flange and having top edges and flanges extending outwarding from the side web top edges;

the hat-section outwardly extending flanges contacting the car side wall vertical plates;

a doubler plate over and in contact with each hat-section outwardly extending flange adjacent a vertical plate on each end of the body bolsters and adjacent portion of the car side wall; and fastener means penetrating the doubler plates, hat-section outwardly extending flanges, car side wall plate and body bolster vertical end plate to secure the said elements together.

10. A gondola car according to claim 9 in which:

each doubler plate is an elongated member wider than the top of the hat-section outwardly extending flange which it contacts;

the outer edge of the doubler plate has a short flange which projects into contact with the car side wall vertical plate; and the inner edge of the doubler plate is rounded and nests in the root portion of the hat-section post formed by the intersection of the hat-section post side webs and outwardly extending flanges.

11. A railroad gondola car comprising:

a center sill;

a pair of generally vertical car end walls;

a pair of generally vertical car side walls joined to the end walls;

a longitudinal side sill at the bottom of each side wall;

a longitudinal top chord at the top of each side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical plate having a lower horizontal edge joined to the side sill and an upper horizontal edge joined to the top chord;

a plurality of spaced apart vertical posts joined to the vertical plate and with one or more vertical posts being joined to the body bolsters and to the cross bearers;

a floor plate supported by the body bolsters and the cross bearers with said floor plate extending between the car end walls and the car side walls;

at least two pair of diagonal braces located inside the car between the side walls; and each pair of diagonal braces comprising two opposing braces each of which has a cast metal connector at an upper end connected to an upper internal portion of a car side wall and a cast metal connector at a lower end connected to means on the car floor.

12. A railroad gondola car comprising:

a center sill;

a pair of generally vertical car end walls;

a pair of generally vertical car side walls joined to the end walls;

a longitudinal side sill at the bottom of each side wall;

a longitudinal top chord at the top of each side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical plate having a lower horizontal edge joined to the side sill and an upper horizontal edge joined to the top chord;

a plurality of spaced apart vertical posts joined to the vertical plate and with one or more vertical posts being joined to the body bolsters and to the cross bearers;

a floor plate supported by the body bolsters and the cross bearers with said floor plate extending between the car end walls and the car side walls;

a lateral horizontal tension tie cross brace located above each body bolster;

each lateral cross brace having a cast connector at each end; and means joining each cast connector to the car side wall.

13. A railroad gondola car comprising:

a center sill;

a pair of generally vertical car end walls;

a pair of generally vertical car side walls joined to the car end walls;

a longitudinal side sill at the bottom of each car side wall;

a longitudinal top chord at the top of each car side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical side wall plate having a lower horizontal edge joined to the side sill and an upper horizontal edge joined to the top chord;

a plurality of spaced apart vertical posts joined to the vertical side wall plate and with one or more vertical posts being joined to body bolsters and cross bearers;

a floor plate supported by the body bolsters and the cross bearers with said floor plate extending for substantially the distance between the end walls and the side walls but having side edges spaced inwardly a short distance from the respective side plate;

each side sill having a horizontal leg on top of the floor plate and a downwardly depending rib on the bottom of the horizontal leg extending into contact with the body bolsters and cross bearers between the respective edges of the floor plates and the car side wall plate;

at least two pair of diagonal braces being located inside the car between the side walls;

each pair of diagonal braces comprising two opposing braces each of which has a cast metal connector at an upper end connected to an upper internal portion of a car side wall and a cast metal connector at a lower end connected to means on the car floor;

each brace being a tubular member;

the end of each tubular member having a separate cast metal connector;

the cast metal connector having an end with an axial slot extending inwardly from the end of the casting;

the side wall upper internal portion having a T-member positioned thereon, with said T-member having the flanges of the T against the car side wall vertical plate and the stem of the T being vertically positioned;

the car floor having a T-member positioned thereon with said T-member having the flanges of the T against the floor plate and the stem of the T being vertically positioned and lateral to the car side walls;

the stem of the T-member on the side wall being located in the slot of the cast metal connector on the upper end of a diagonal brace; and the stem of the T-member on the floor plate being located in the slot of the cast metal connector on the lower end of the diagonal brace.

14. A gondola car according to claim 13 in which the cast metal connectors are connected to the T-member stems by fasteners which extend through the cast metal connector and the T-member stems.

15. A gondola car according to claim 13 in which:

each T-member on a car side wall is opposite a car side wall post.

16. A gondola car according to claim 15 in which:

each car side wall post is a hat-section structural member comprising a base flange having side webs extending normal to the flange and having top edges and flanges extending outwarding from the side web top edges;

the hat-section outwardly extending flanges contact the car side wall vertical plates;

a doubler plate is located over and in contact with each hat-section outwardly extending flange; and fastener means penetrate the doubler plates, hat-section outwardly extending flanges, car side wall and T-member flanges to secure the said elements together.

17. A gondola car according to claim 16 in which:

each doubler plate is an elongated member wider than the top of the hat-section outwardly extending flange which it contacts;

the outer edge of the doubler plate has a short flange which projects into contact with the car side wall vertical plate; and the inner edge of the doubler plate is rounded and nests in the root portion of the hat-section post formed by the intersection of the hat-section post side webs and the outwardly extending hat-section flanges.

18. A railroad gondola car comprising:

a center sill;

a pair of generally vertical car end walls;

a pair of generally vertical car side walls joined to the car end walls;

a longitudinal side sill at the bottom of each car side wall;

a longitudinal top chord at the top of each car side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical side wall plate having a lower horizontal edge joined to the side sill and an upper horizontal edge joined to the top chord;

a plurality of spaced apart vertical posts joined to the vertical side wall plate and with one or more vertical posts being joined to body bolsters and cross bearers;

a floor plate supported by the body bolsters and the cross bearers with said floor plate extending for substantially the distance between the end walls and the side walls but having side edges spaced inwardly a short distance from the respective side plate;

each side sill having a horizontal leg on top of the floor plate and a downwardly depending rib on the bottom of the horizontal leg extending into contact with the body bolsters and cross bearers between the respective edges of the floor plates and the car side wall plate;

a lateral horizontal tension tie cross brace located above each body bolster;

each lateral cross brace having a cast connector at each end;

means joining each cast connector to the car side wall;

each lateral cross brace being a tubular member;

the end of each tubular member having a separate cast metal connector;

the cast connector having an end with an axial slot extending inwardly from the end of the casting;

the car side wall upper internal portion having a T-member positioned thereon, with said T-member having the flanges of the T against the car side wall vertical plate and the stem of the T being vertically positioned; and the stem of the T-member on the car side wall being located in the slot of a cast connector on the lateral cross brace.

19. A gondola car according to claim 18 in which the cast connectors are connected to the T-member stems by fasteners which extend through the cast connectors and the T-member stems.

20. A gondola car according to claim 18 in which:

each T-member on a car side wall is opposite a car side wall post.

21. A gondola car according to claim 20 in which:

each car side wall post is a hat-section structural member comprising a base flange between side webs extending normal to the flange and having top edges and flanges extending outwarding from the side top edges;

the hat-section outwardly extending flanges contact the car side wall vertical plates;

a doubler plate is located over and in contact with each hat-section outwardly extending flange; and fastener means penetrate the doubler plates, hat-section outwardly extending flanges, car side wall plate and T-member flanges to secure the said elements together.

22. A gondola car according to claim 21 in which:

each doubler plate is an elongated member wider than the top of the hat section outwardly extending flange which it contacts;

the outer edge of the doubler plate has a short flange which projects into contact with the car side wall vertical plate; and the inner edge of the doubler plate is rounded and nests in the root portion of the hat-section post formed by the intersection of the hat-section post side webs and outwardly extending hat-section flanges.

23. A railroad gondola car comprising:

a center sill;

a pair of generally vertical car end walls;

a pair of generally vertical car side walls joined to the end walls;

a longitudinal side sill at the bottom of each side wall;

a longitudinal top chord at the top of each side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical plate having a lower horizontal edge joined to the side sill and an upper horizontal edge joined to the top chord;

a plurality of spaced apart vertical posts joined to the vertical plate and with one or more vertical posts being joined to the body bolsters and to the cross bearers;

a floor plate supported by the body bolsters and the cross bearers with said floor plate extending between the car end walls and the car side walls;

at least two pair of diagonal braces located inside the car between the side walls;

each pair of diagonal braces comprising two opposing braces each of which has a cast metal connector at an upper end connected to an upper internal portion of a car side wall and a cast metal connector at a lower end connected to means on the car floor;

each brace being a tubular member;

the end of each tubular member having a separate cast metal connector;

the cast metal connector having an end with an axial slot extending inwardly from the end of the casting;

the car side wall upper internal portion having a T-member positioned thereon, with said T-member having the flanges of the T against the car side wall vertical plate and the stem of the T being vertically positioned;

the car floor having a T-member positioned thereon with said T-member having the flanges of the T against the floor plate and the stem of the T being vertically positioned and lateral to the car side walls;

the stem of the T-member on the respective car side wall being located in the slot of the cast metal connector on the upper end of a diagonal brace; and the stem of the T-member on the floor plate being located in the slot of the cast metal connector on the lower end of the diagonal brace.

24. A gondola car according to claim 23 in which the castings are connected to the T-member stems by fasteners which extend through the cast metal connector and the T-member stems.

25. A railroad gondola car comprising:

a center sill;

a pair of generally vertical car end walls;

a pair of generally vertical car side walls joined to the end walls;

a longitudinal side sill at the bottom of each side wall;

a longitudinal top chord at the top of each side wall;

a body bolster near each end of the car extending from the center sill to the side sills;

a railway truck having a bolster;

each body bolster adapted to be supported on a railway truck bolster;

a plurality of cross bearers extending from the center sill to the side sills;

each vertical side wall including a vertical plate having a lower horizontal edge joined to the side sill and an upper horizontal edge joined to the top chord;

a plurality of spaced apart vertical posts joined to the vertical plate and with one or more vertical posts being joined to the body bolsters and to the cross bearers;

a floor plate supported by the body bolsters and the cross bearers with said floor plate extending between the car end walls and the car side walls;

a lateral horizontal tension tie cross brace located above each body bolster;

each lateral cross brace having a cast connector at each end;

means joining each cast connector to the car side wall;

each cross brace being a tubular member;

the end of each tubular member having a separate cast metal connector;

the cast metal connector having an end with an axial slot extending inwardly from the end of the casting;

the car side wall upper internal portion having a T-member positioned thereon, with said T-member having the flanges of the T against the car side wall vertical plate and the stem of the T being vertically positioned; and the stem of the T-member on the respective car side walls being located in the slot of the cast metal connectors on the ends of each cross brace.

26. A gondola car according to claim 25 in which the cast metal connectors are connected to the T-member stems by fasteners which extend through the cast metal connector and the T-member stems.

* * * * *

UNITED STATES PATENT AND TRADEMARK OFFICE

CERTIFICATE OF CORRECTION

PATENT NO. : 4,930,427

DATED : June 5, 1990

INVENTOR(S) : JOHN A. RITTER ET AL

It is certified that error appears in the above-identified patent and that said Letters Patent is hereby corrected as shown below:

Face sheet, in block [75] change "Jozes" to -- Jozef --; column 3, line 11, column 8, line 8, column 9, line 7, column 11, line 36, column 12, line 58, change "outwarding" to -- outwardly --; column 3, line 22, change "double" to -- doubler --.

Signed and Sealed this

First Day of October, 1991

*Attest:*

*Attesting Officer*

HARRY F. MANBECK, JR.

*Commissioner of Patents and Trademarks*